US007007832B1

(12) United States Patent
Payne

(10) Patent No.: US 7,007,832 B1
(45) Date of Patent: Mar. 7, 2006

(54) ARTISAN'S UTILITY APRON

(76) Inventor: Aeriel Payne, 238 Peters St., Unit 201, Atlanta, GA (US) 30313

( * ) Notice: Subject to any disclaimer, the term of this patent is extended or adjusted under 35 U.S.C. 154(b) by 395 days.

(21) Appl. No.: 10/610,003

(22) Filed: Jun. 30, 2003

(51) Int. Cl.
*A45F 3/00* (2006.01)

(52) U.S. Cl. ..... 224/660; 224/677; 224/680; 224/681; 224/684; 224/901.4; 224/904

(58) Field of Classification Search ..... 224/223, 224/241, 250, 660, 661, 676, 677, 680, 681, 224/682, 683, 684, 901.4, 904; 2/48, 51
See application file for complete search history.

(56) References Cited

U.S. PATENT DOCUMENTS 1,655,527 A * 1/1928 Abrahams ..... 224/223
1,675,072 A * 6/1928 Watermon ..... 2/48
3,886,508 A * 5/1975 Lavrard ..... 224/183
4,079,465 A 3/1978 Alexander
D257,596 S 12/1980 Rosenbloom, III
D258,020 S 1/1981 Bryce
4,370,757 A 2/1983 Richmond
4,545,079 A 10/1985 Bakken
4,697,286 A 10/1987 Cho
4,852,782 A * 8/1989 Wu et al. ..... 224/661
4,953,765 A * 9/1990 Little et al. ..... 224/904
D312,854 S 12/1990 Meyer
4,993,614 A * 2/1991 Bonofiglo ..... 224/677
5,033,124 A 7/1991 Bucalo et al.
D348,983 S * 7/1994 Dancyger ..... D3/224
5,375,262 A 12/1994 Carter
5,385,281 A 1/1995 Byrd
5,445,303 A * 8/1995 Cawile, Jr. ..... 224/661
5,517,696 A * 5/1996 Krugler ..... 224/223
D373,892 S 9/1996 Landwehr
5,690,261 A * 11/1997 Moore ..... 224/250
6,065,659 A * 5/2000 Faz ..... 224/661
6,073,823 A 6/2000 Gordon
6,202,215 B1 3/2001 Sauter
6,213,365 B1 * 4/2001 Stocke et al. ..... 224/223
6,338,164 B1 1/2002 Howard
6,390,348 B1 * 5/2002 Godshaw et al. ..... 224/660
D458,437 S 6/2002 Vazquez
6,398,092 B1 * 6/2002 Ansley ..... 224/677
6,446,852 B1 * 9/2002 Sorensen et al. ..... 224/661
6,473,905 B1 11/2002 Katz
6,665,875 B1 * 12/2003 Alonso et al. ..... 2/51
6,684,413 B1 * 2/2004 Cascioli ..... 2/312
6,712,251 B1 * 3/2004 Godshaw et al. ..... 224/904

* cited by examiner

*Primary Examiner*—Gary E. Elkins
(74) *Attorney, Agent, or Firm*—Troutman Sanders LLP; Ryan A. Schneider

(57) ABSTRACT

An artisan's such as a makeup artist's, hairstylist's, or artist's utility apron provides for the carriage of items such as makeup brushes, hairspray, combs, and additional tools and articles. The apron includes a belt portion with two separate sets of closures for securing the belt around a user's waist; a buttonable closure in the front, and, a two-piece side release buckle including an adjustable strap and hook-and-loops fastener in the back. The belt portion has a plurality of belt loops for hanging articles. First and second leg apron portions are integrally connected to and depend from the belt portion positioned at the user's sides. The apron portions include a plurality of open pockets and pocket loops for storage of articles. The apron is reversible 180 degrees around a waistline for either left-handed or right-handed users. The apron is constructed from a variety of natural or synthetic materials.

20 Claims, 8 Drawing Sheets

ARTISAN'S UTILITY APRON

CROSS-REFERENCE TO RELATED APPLICATONS

A design patent application for the same invention by the same inventor has been filed simultaneously with this application on Jun. 30, 2003.

FEDERALLY SPONSORED RESEARCH

Not applicable.

SEQUENCE LISTING OR PROGRAM

Not Applicable.

BACKGROUND OF THE INVENTION

1. Field of Invention

The present invention relates generally to multi-purpose utility aprons and carriers adapted to specialized uses and trades, and more specifically to a utility apron providing for the carriage of at least several brushes, as well as other tools and articles commonly used in the makeup artist, hair stylist, art, tailoring, and similar such trades.

2. Background of the Invention

Artisans such as makeup artists, hair stylists, artists, and tailors spend a great deal of time moving including sitting, standing, kneeling, reaching, climbing, walking, bending, and contorting in order to position his or herself properly to work on their subject. The subject may be sitting, standing, posing, or in some other common or uncommon position. Additionally, the subject may be distantly located from the artisans' storage place for tools and articles. Thus, the combination of the movements of the artisan and the subject, along with a potential distance an artisan may need to travel, requires the artisan to have a versatile carrier for tools needed for a given task.

Although various aprons exist in the prior art, they are typically designed as full frontal chest aprons or smocks, or, waist aprons with a single apron portion positioned in front of the artisan. In the case of these frontally positioned aprons in the prior art, the artisan experiences impaired movement, inaccessibility of tools, and risk of tools falling out of the apron's pockets and loops. Bending motion compresses the frontal apron portion's pockets and loops thereby causing brushes and other tools to fall out of the pockets and loops. Invariably, the artisan wearing a front panel waist apron is hindered, uncomfortable, experiences inaccessibility of tools, and his or her work is slowed due to a lack of freedom of movement.

Know prior art includes U.S. Pat. Nos. 4,079,465; 4,370,757; 4,545,079; 4,697,286; 5,033,124; 5,375,262; 5,385,281; 6,073,823; 6,202,215; 6,338,164; 6,473,905. U.S. Des. Pat. Nos. D257,596; D258,020; D373,892; D458,437. While these devices fulfill their respective, particular objectives and requirements, the aforementioned patents do not disclose new artisan utility aprons. Additionally, this inventor has eight years of work experience in the field of makeup artistry and has not been witness to any artisan utility apron which is similar to the present invention.

The need arises for a utility apron for makeup artists, hair stylists, artists, tailors and similar such artisans which allows greater freedom of movement, greater accessibility of tools, more versatility, and that will keep tools and other items in its pockets and loops during the artisan's movements. The apron should be easily adjustable for differently sized persons. The apron should hold different sizes of brushes, hairspray canisters, combs, sponges, brushes, makeup canisters, and similar tools and articles. The apron should also be easily adaptable to either left-handed or right-handed users. The apron should also be washable for multiple reuses, lightweight, and compact for non-use travel.

BACKGROUND OF THE INVENTION

3. Objects and Advantages

Although various aprons exist in the prior art, none have the unique features and advantages according to the present invention. While some such utility aprons may have multiple pockets or hooks affixed to a front panel waist apron, or are styled as chaps, no utility apron is designed with two side portions. Thus, the inventive utility apron substantially departs from the conventional concepts and designs of the prior art.

Accordingly, besides the objects and advantages of the apron described in my patent, several objects and advantages of the present invention are:

(a) to provide a utility apron which belt portion is adjustably securable by two separate closures, one on the back of a user which includes a two-piece side release buckle with adjustable strap and added hook and loops fastener, and, a second on the front of the user including rivets with attendant grommets;

(b) to provide a utility apron which belt portion includes a plurality of vertically disposed belt loops for hanging various tools and articles;

(c) to provide a utility apron which has first and second leg apron portions which are integrally connected to and depend from the belt portion;

(d) to provide a utility apron which has apron portions disposed to both sides of the user;

(e) to provide a utility apron which has first and second leg apron portions which have a plurality of pockets and pocket loops on each, and where the apron portions are positioned to the sides of the user;

(f) to provide a utility apron designed with two side apron portions which allows the user greater freedom of movement;

(g) to provide a utility apron which has apron portions including a plurality of open pockets and pocket loops of different sizes therein;

(h) to provide a utility apron which is reversible 180 degrees around the waistline of the user;

(i) to provide a utility apron which may be constructed from a variety of natural or synthetic materials, such as denim; and (j) to provide a utility apron for the purposes described which is inexpensive, dependable, functional, adjustable, lightweight, washable, reusable, and fully effective in accomplishing its intended purpose.

Further objects and advantages are to provide an artisan's utility apron which is fully functional for work and leisure, highly adaptable to each user's physique and dominant hand, allows unrestricted movement of the user, and can carry all tools and articles the artisan may need for a given task.

With these and other objects in view which will more readily appear as the nature of the invention is better understood, the invention consists in the novel combination and arrangement of parts hereinafter more fully described, illustrated and claimed with reference being made to the attached drawings. Still further objects and advantages will become apparent from a consideration of the ensuing description and drawings.

SUMMARY

In accordance with the present invention a utility apron comprises a belt portion with two separate mating attachment means on transverse opposite sides of said belt portion, and, first and second leg apron portions depending from said belt portion, with said apron portions comprising a plurality of pockets and loops.

DRAWINGS—FIGURES

In the drawings, closely related figures have the same number but different alphabetic suffixes. Additionally, the broken or dotted lines shown throughout the drawings are used to represent conventional stitching.

DRAWINGS—REFERENCE NUMERALS

Figure 1:
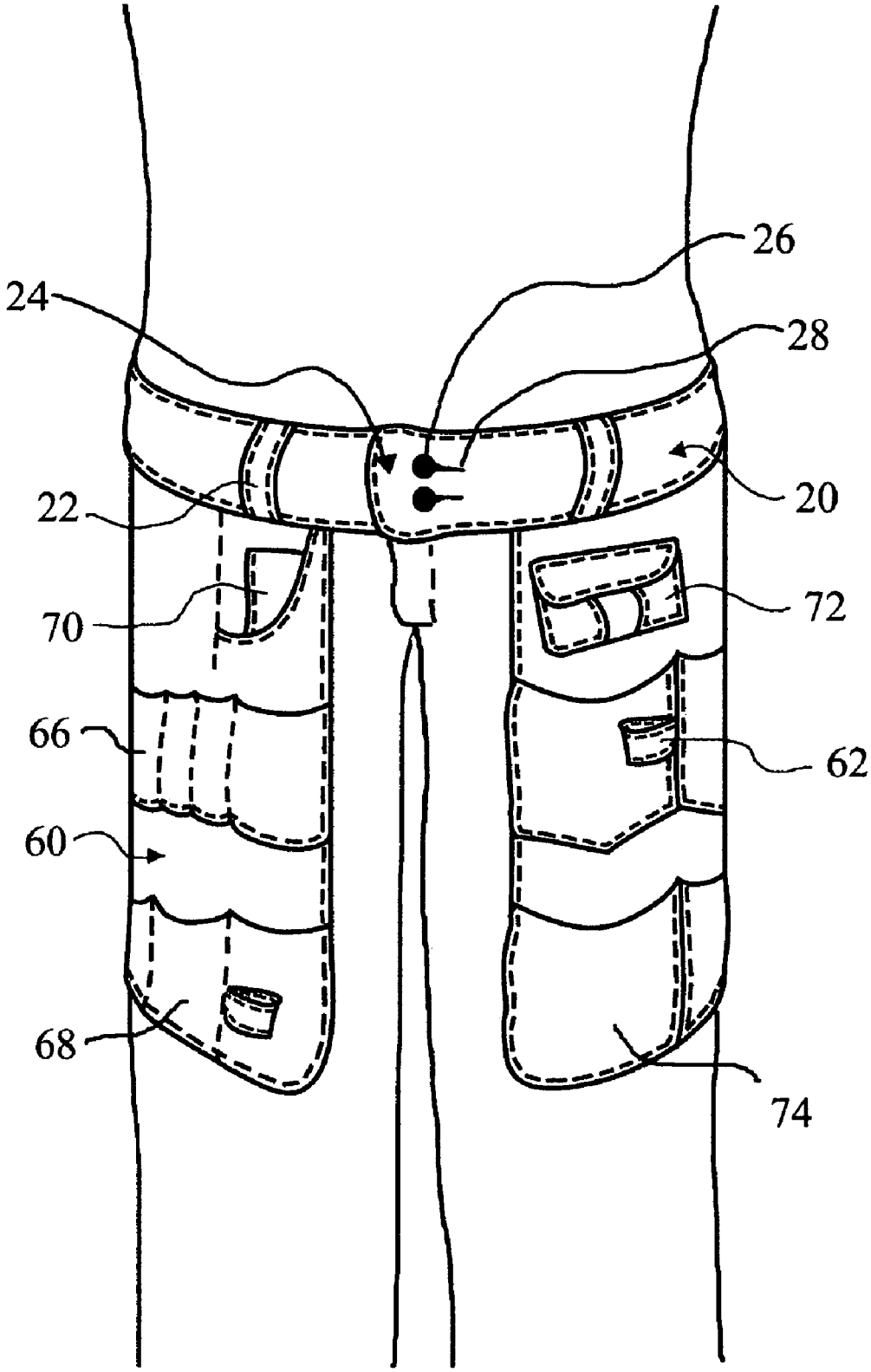
FIG. 1 shows a front perspective view of a human wearing the utility apron with the belt portion around the human's waistline.

20 belt portion
22 belt loop
24 belt portion first and second ends (front)
26 rivet
28 grommet
30 belt portion third and fourth ends (back)
32 two-piece side release buckle with adjustable strap connector
34 adjustable strap
36 hook-and-loops fastener
60 apron portion
62 pocket loop
64 large cargo pocket
66 large five section pocket
68 large three section pocket
70 small money pocket
72 small cargo pocket
74 large open storage pocket Similar reference characters denote corresponding features consistently throughout figures of the attached drawings.

DETAILED DESCRIPTION—FIGS. 1, 2A, 2B, 3A, 3B, 4A, 4B—PREFFERRED EMBODIMENT

Referring now to the drawings, a preferred embodiment of the utility apron is illustrated in FIGS. 1, 2A, 2B, 3A, 3B, 4A, and 4B. Additionally, the broken or dotted lines shown throughout the drawings are used to represent conventional stitching.

FIG. 1 shows a front perspective view of a human wearing the utility apron with the belt portion 20 around the human's waistline. The belt portion 20 is joinable by two separate sets of mating attachment means for securing the belt portion around a user's waist; one positioned in the front of the user and a second positioned at the user's back. The belt portion is securable in the front with a buttonable closure 24, 26, 28. The belt portion has one, two, three, four or more belt loops 22 from which tools may be hanged. From said belt portion depend two apron portions 60 where said apron portions are positioned so they cover primarily the sides of the user. Said apron portions transverse centerlines are positioned over the sides of the user. The apron portions are also positioned so they do not cover directly the front nor directly the back of the user. Said apron portions are integrally coupled to the belt portion by stitching or other suitable means. As viewed, the apron shows a front belt mating attachment means 24, 26, 28, a plurality of large open pockets 74, a small cargo pocket 72, one large three section pocket 68, one large five section pocket 66, a small money pocket 70, two pocket loops 62, and two belt loops 22.

Figure 2A:
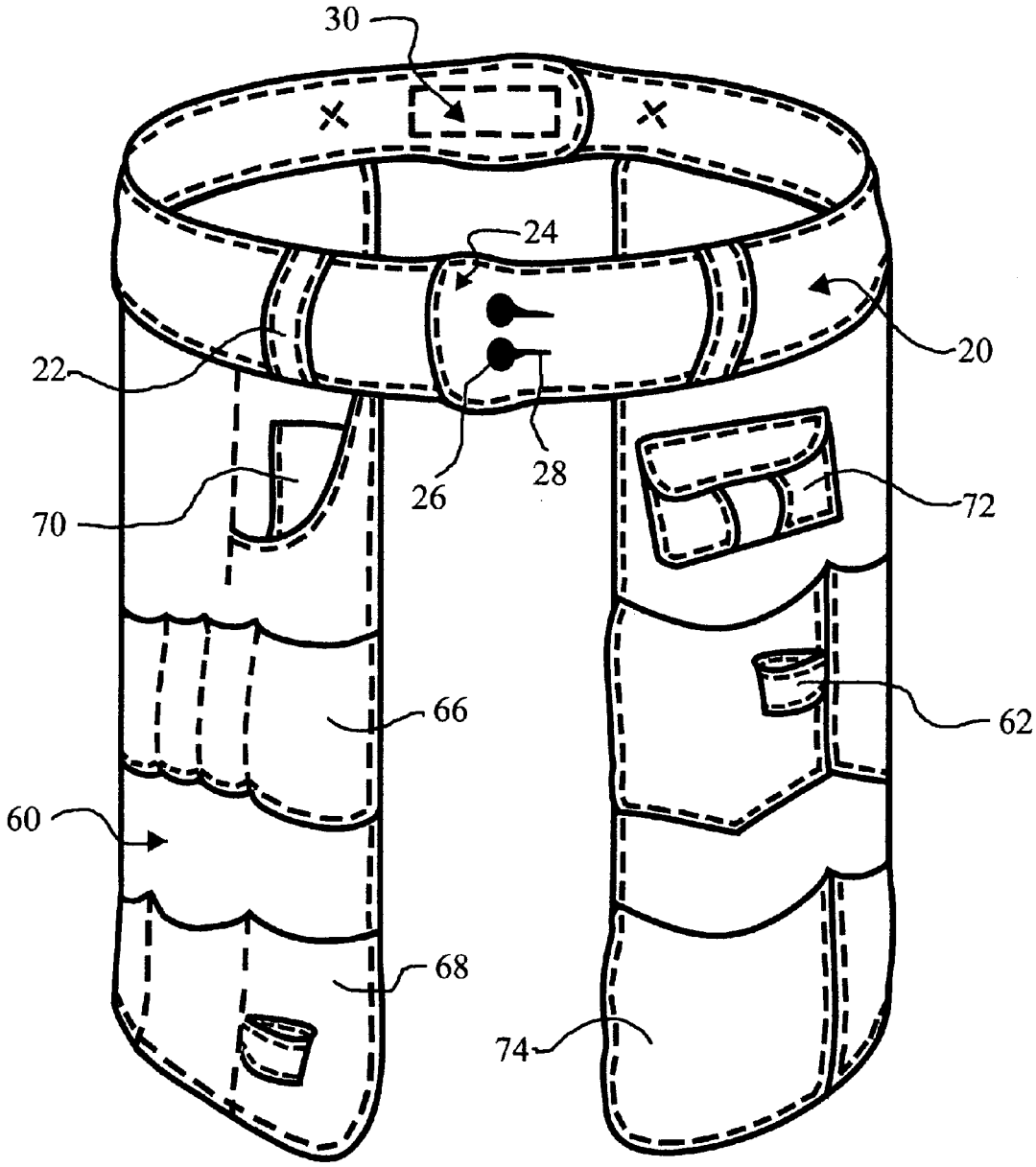
FIG. 2A shows a front perspective view.

FIG. 2A shows a front perspective view. In addition to the parts described in FIG. 1 above, FIG. 2A further shows how two apron portions 60 depend from the belt portion 20 where said apron portions are positioned so they cover the primarily the sides of the user. The apron portions 60 are also positioned so they do not cover directly the front nor directly the back of the user. FIG. 2A also discloses the interior of the back belt portion 30 where the belt portions overlap internally for comfort.

Figure 2B:
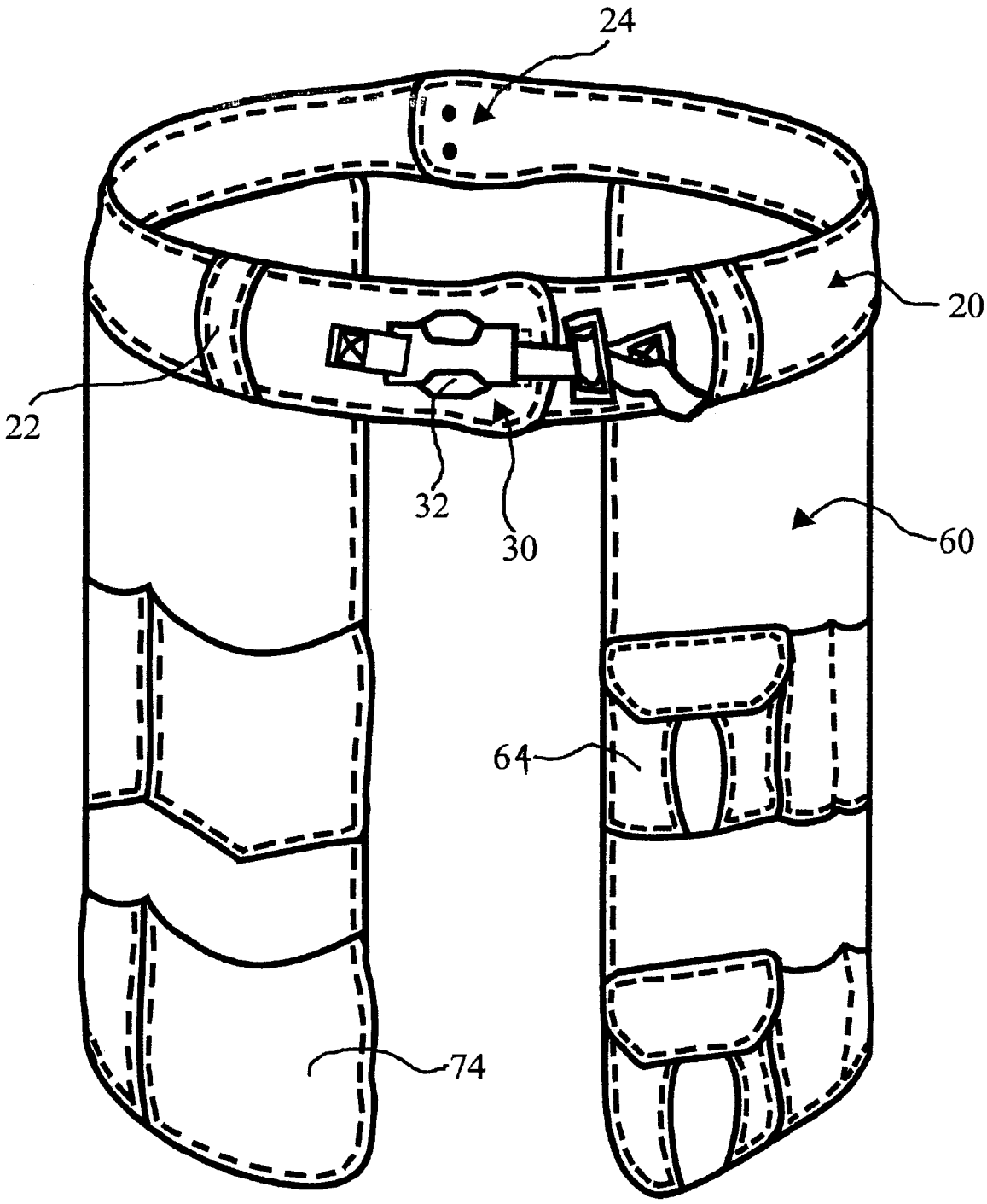
FIG. 2B shows a back perspective view.

FIG. 2B shows a back perspective view. In addition to the parts described in FIG. 1 above, FIG. 2B further shows how said apron portions 60 are positioned so they cover primarily the sides of the user. The apron portions 60 are also positioned so they do not cover directly the front nor directly the back of the user. FIG. 2B also discloses the interior of the front belt mating attachment means 24, 26. FIG. 2B also discloses the exterior of the belt third and fourth ends' mating attachment means 30 comprising a two-piece side release buckle with adjusting strap 32. FIG. 2B also shows two belt loops 22.

Figure 3A:
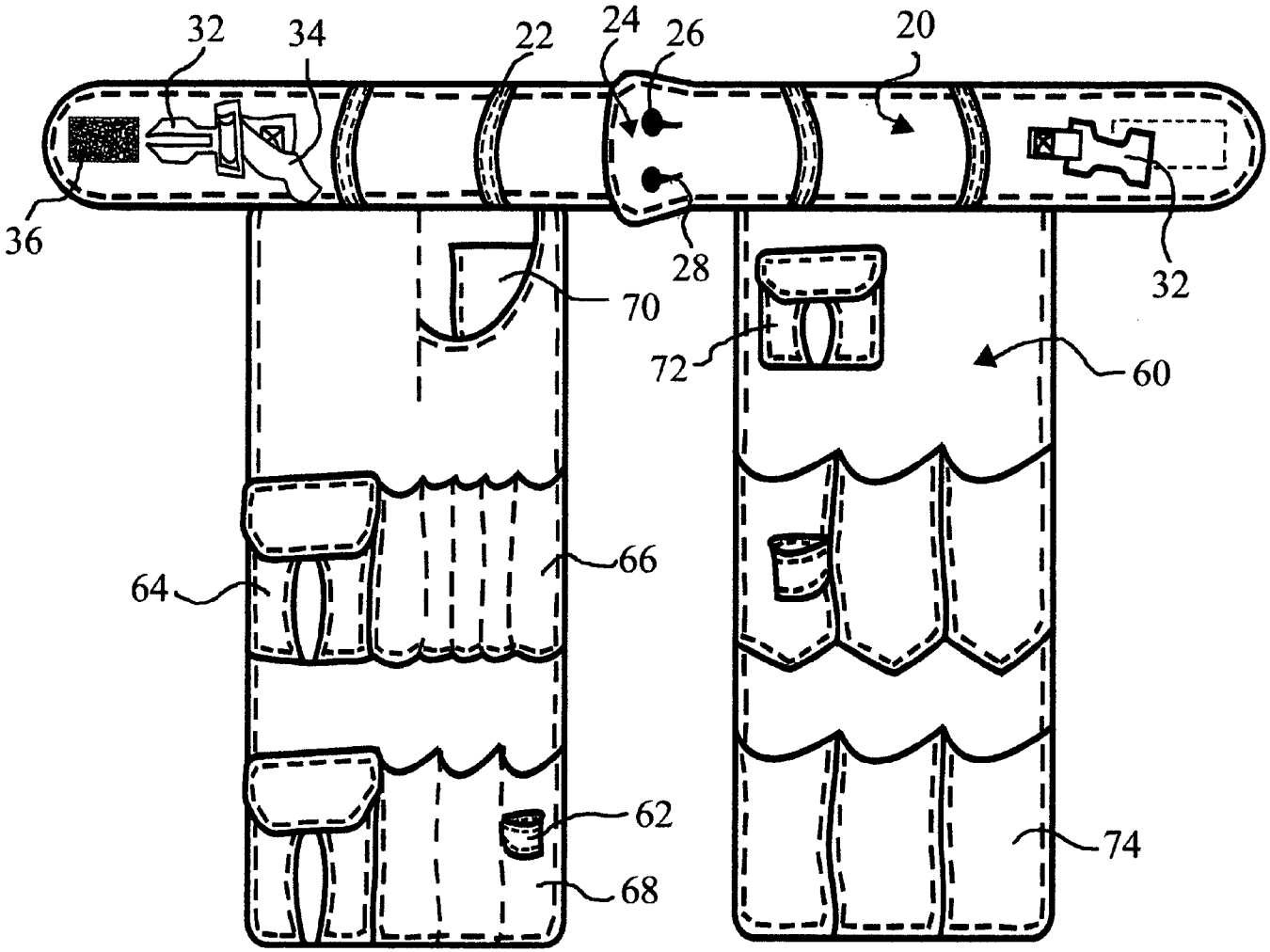
FIG. 3A shows a full front perspective view of the apron's exterior with the belt portion's back closure uncoupled.

FIG. 3A shows a full exterior front view with the back belt mating attachment means was uncoupled. FIG. 3A discloses hook-and-loops fastener 36. FIG. 3A discloses the major elements as identified by the drawing reference numerals.

Figure 3B:
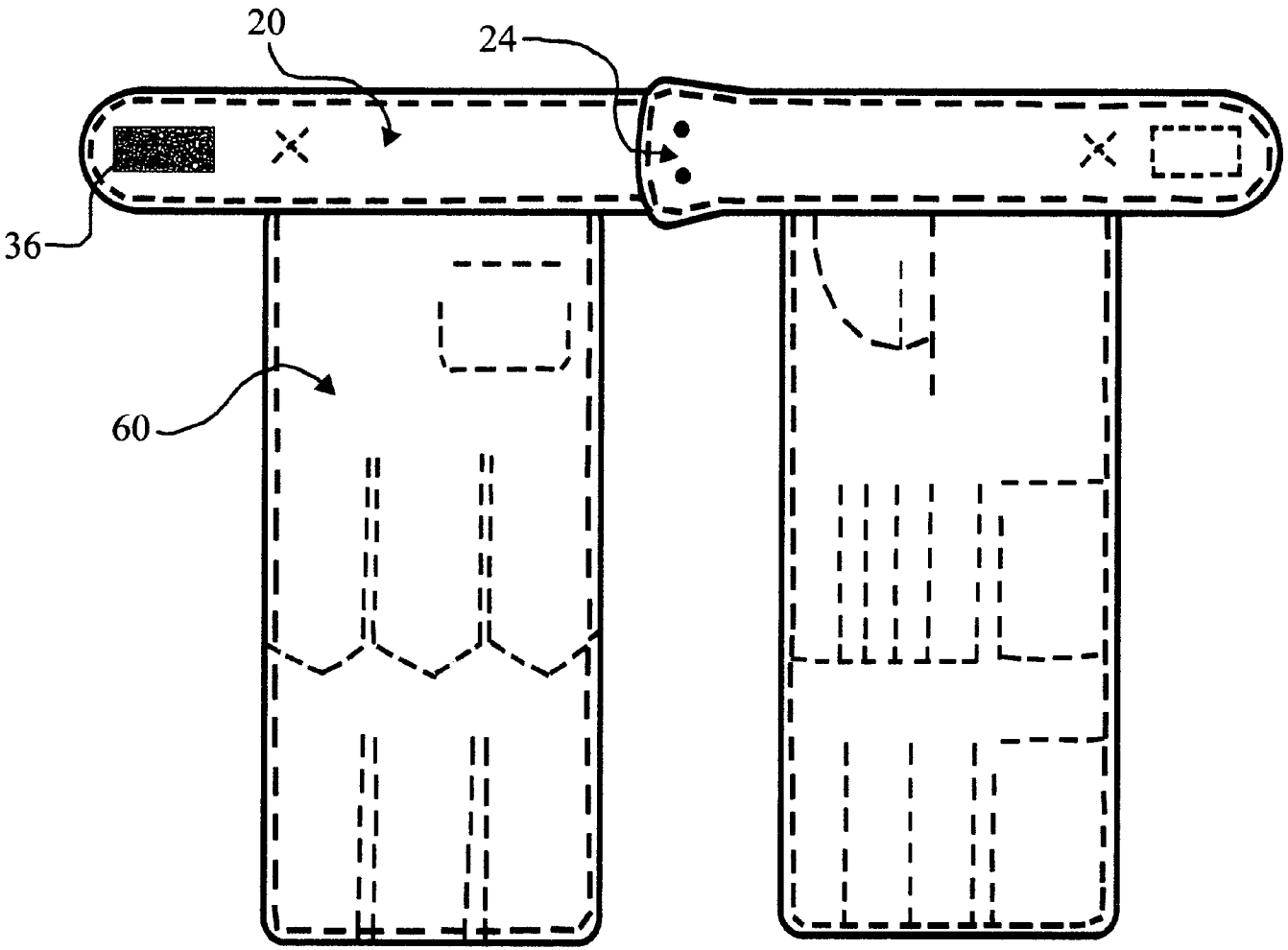
FIG. 3B shows a full back perspective view of the apron's interior with the belt portion's back closure uncoupled.

FIG. 3B shows a full interior back view with the back belt mating attachment means was uncoupled. FIG. 3B discloses hook-and-loops fastener 36. FIG. 3B discloses the major elements as identified by the drawing reference numerals.

Figure 4A:
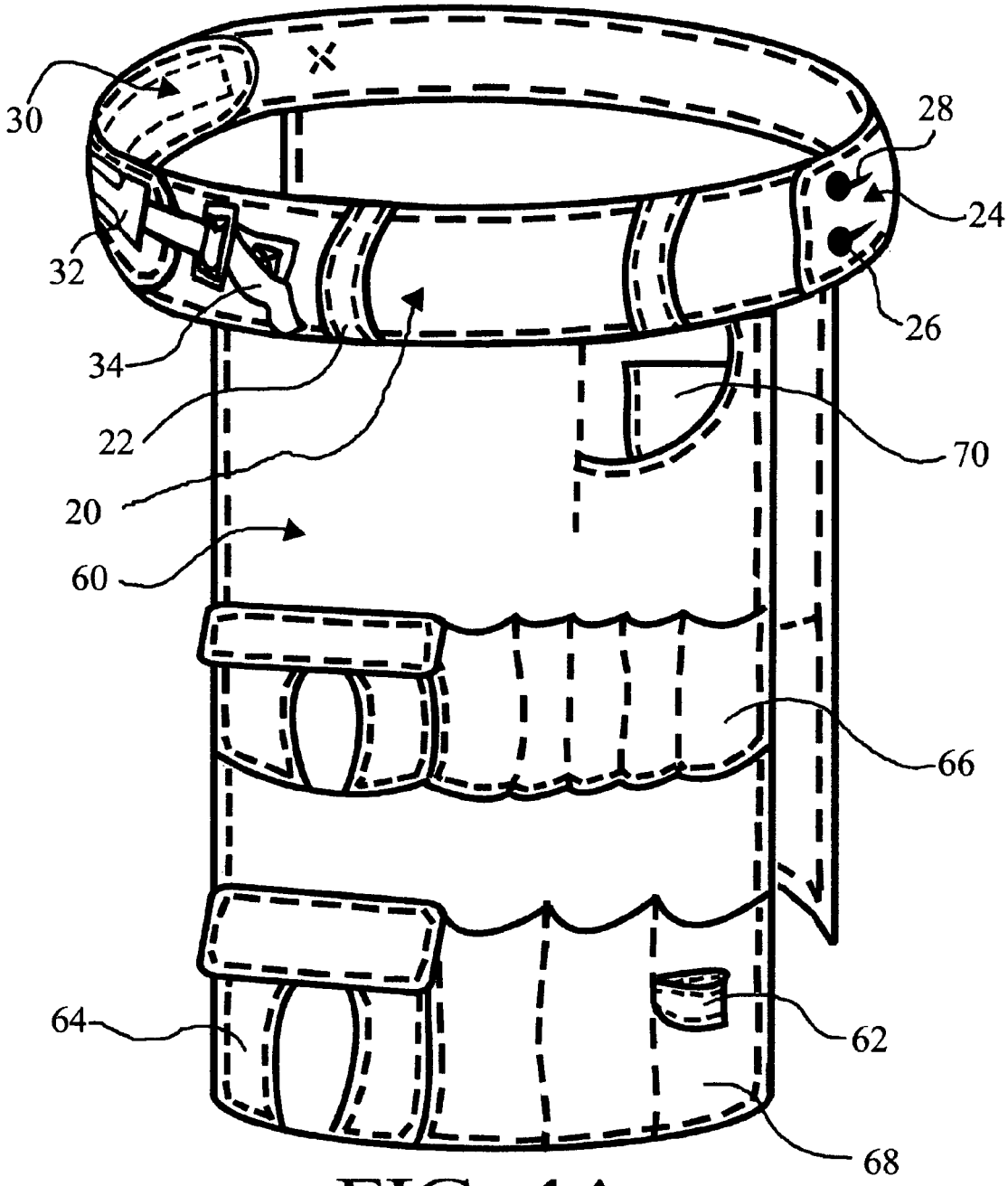
FIG. 4A shows a side perspective view from the right side.

FIG. 4A shows a side perspective view from the user's right side. FIG. 4A discloses a user's right side apron portion 60. FIG. 4A discloses the major elements of the right side apron portion as identified by the drawing reference numerals.

Figure 4B:
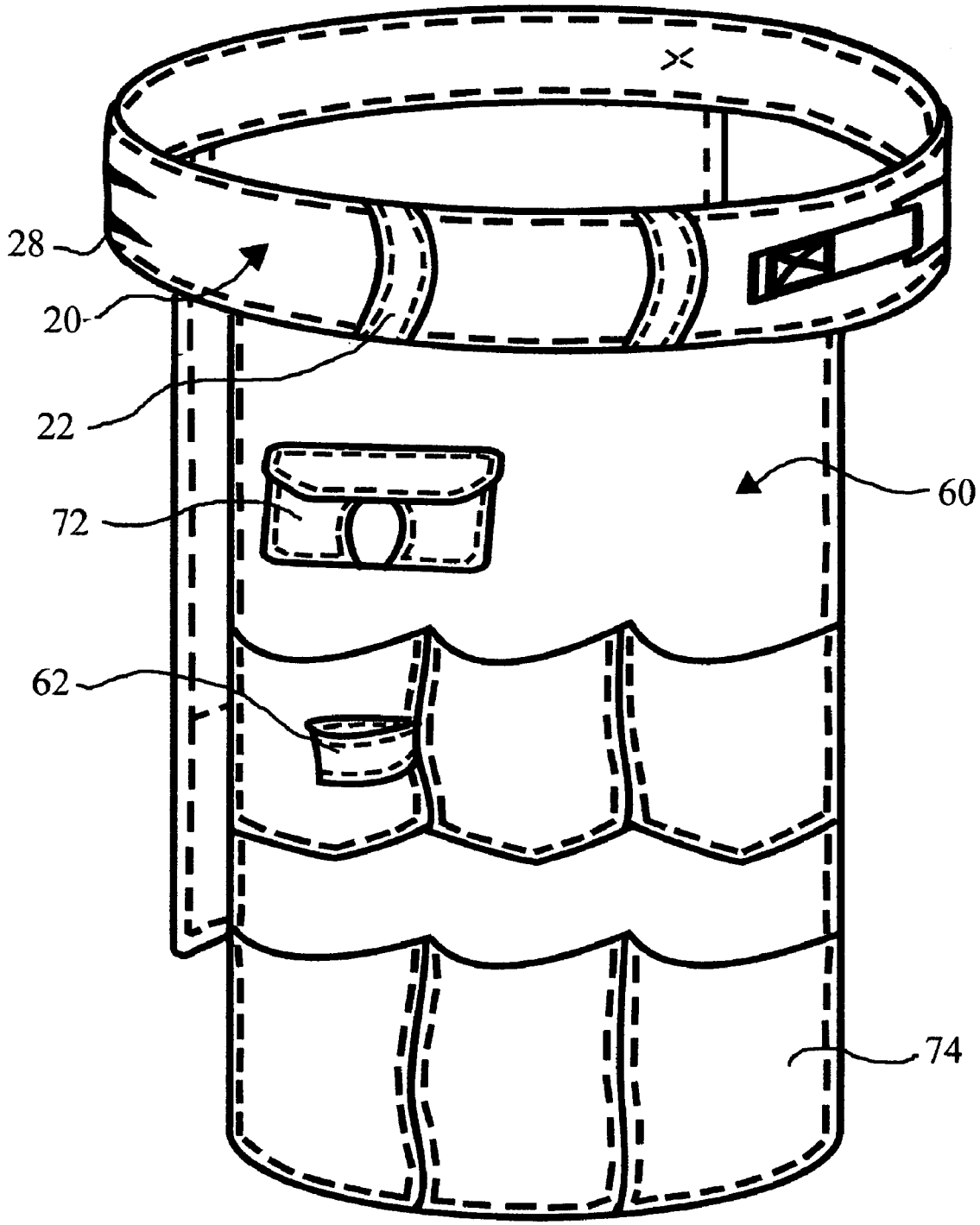
FIG. 4B shows a side perspective view from the left side.

FIG. 4B shows a side perspective view from a user's left side. FIG. 4B discloses a user's left side apron portion 60. FIG. 4B discloses the major elements of the left side apron portion as identified by the drawing reference numerals.

Figure 5:
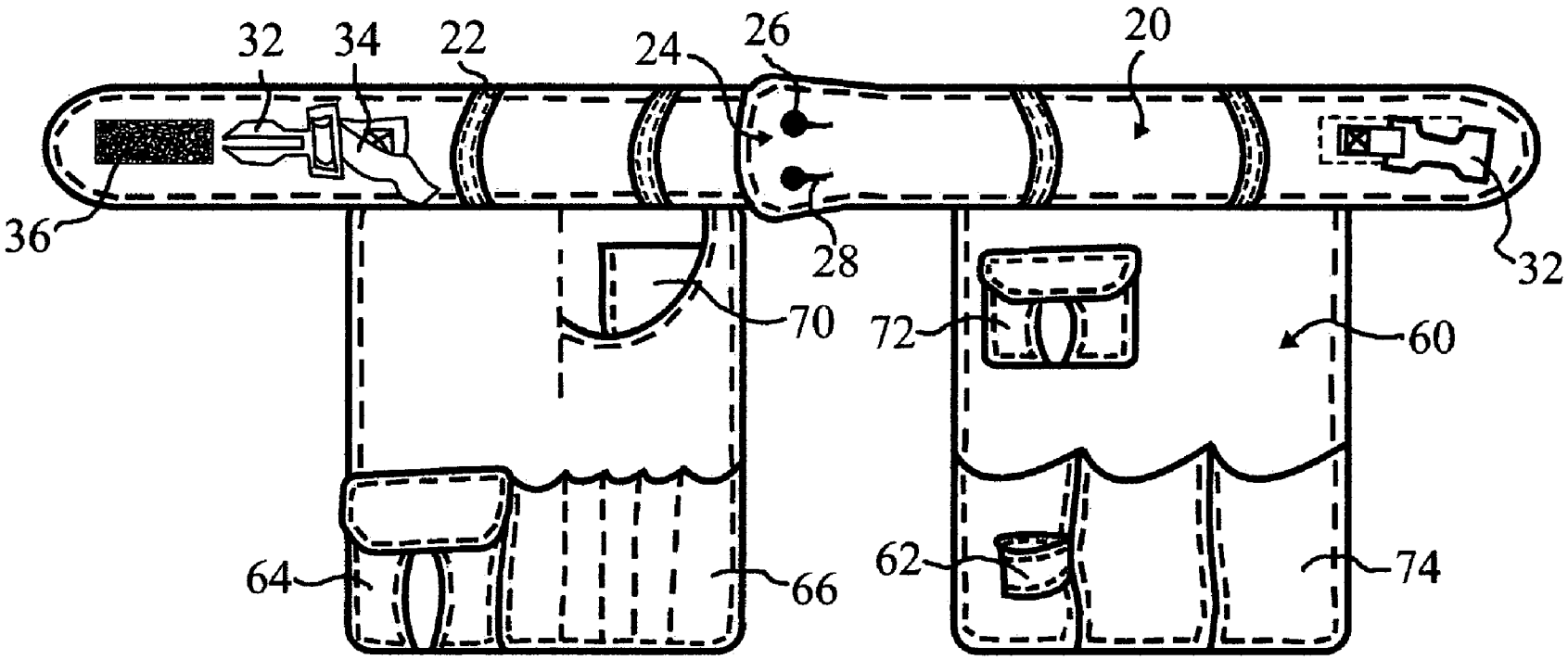
FIG. 5 shows an alternative embodiment of the utility apron in a full front perspective view of the apron's exterior with the belt portion's back closure uncoupled.

FIG. 5—Additional Embodiment

An additional embodiment is shown in FIG. 5. FIG. 5 shows an alternative embodiment of the apron in a front perspective view. The FIG. 5 embodiment shows the apron portions 60 with only one transverse row of pockets 64, 66, 74.

Alternative Embodiments

There are various possibilities with regard to the relative length and width of the apron portions, as shown in FIG. 5 by one possible additional embodiment. There are also various possibilities with regard to the pocket and loop configurations on the apron portions as shown in FIG. 5 by one possible additional embodiment. In conjunction with different apron portion lengths and widths, pocket and loop configurations on the apron portions, and combinations between these variables, there are also various possibilities with regard to varying the relative circumference of the belt portion.

Operation—FIGS. 1, 2A, 2B, 3A, 3B, 4A, and 4B.

The manner of using the apron is shown by FIG. 1. A human user can wear the belt portion 20 around his or her waist allowing the apron portions 60 to drape to the user's sides. Once the apron is adorned, the user can reach with his or her arms to the apron portions' pockets 64, 66, 68, 70, 72, 74, and loops 22, 62, for various tools and articles. The user can tighten the belt portion by the adjustable strap 34 which is attached to the two-piece side release buckle 32.

The apron is reversible. The user can reverse the apron by rotating it 180 degrees around the user's waist. This feature allows both left-handed and right-handed users to orient the apron so the pockets and loops are positioned to benefit the user's dominant hand. The reversibility feature also allows a user to reposition tools and articles that are already placed within pockets and loops without removing and then repocketing or rehooking the tools and articles. The reversibility feature additionally allows the user to select which belt closure, the front buttonable 24, 26, 28, or, back two-piece side release buckle 32, the user wants in front of him or her.

Advantages

From the description above, a number of advantages of my utility apron become evident:

(a) the belt portion can be designed with different circumferences to fit the physical size of different users;

(b) the belt portion can be designed with different widths between the upper edge and the opposite lower edge to fit the physical size and comfort needs of different users;

(c) the belt portion can be constructed from a different material than the apron portions for added strength, comfort, and design properties;

(d) the belt portion is adjustably securable by two separate mating attachment means one of which in the front comprises rivets with grommets, or, similar closure means adaptable to meet the needs of a user;

(e) the belt portion is adjustably securable by two separate mating attachment means one of which in the back comprises a two-piece side release buckle with adjustable strap and added hook-and-loops fastener, or, similar closure means adaptable to meet the needs of a user;

(f) the utility apron is designed with two side portions allowing greater freedom of movement for a user than a single frontally positioned apron portion would allow;

(g) the utility apron includes apron portions depending from the belt portion on the user's waistline where the weight of materials held in the apron is more easily supported as opposed to an apron that may hang from the user's neck or directly in front of the user;

(h) the aprons portions include a plurality of pockets and loops of different sizes and can be designed in different configurations with differing pockets and loops;

(i) the apron portions can be designed with different lengths and breadths to fit the physical size of different users;

(j) in combination, the overall apron can be sized and configured differently by changing the pocket and loop size and configuration, the apron portion lengths and widths, and belt portion circumference;

(k) the utility apron portions are positioned to the side of the user of the apron, in order to place the loops and pockets and any articles carried therein to the sides of the user where the user's arms naturally hang;

(l) the apron portions are disposed to both sides of the center of the user so that activities such as sitting, standing, kneeling, reaching, climbing, walking, bending and contorting, and other similar activities are performed by the user with greater freedom of movement and so as not to bend nor compress the apron portions which would cause the pockets and loops to be compressed and further cause items to fall out of the pockets and loops;

(m) the utility apron may be formed of a variety of natural or synthetic materials such as denim, or, a combination of both natural and synthetic materials;

(n) the utility apron is reversible 180 degrees around the waist of the user and thus adaptable to a left-handed or right-handed users; and (o) the utility apron is dependable, functional, adjustable, and fully effective in accomplishing its intended purpose.

CONCLUSION, RAMIFICATIONS, AND SCOPE

Accordingly, the reader will see that the utility apron is extremely effective for its intended purpose. An artisan such as a makeup artist, hair stylist, artist, or tailor can maneuver his or herself in many different positions with great freedom of movement while having needed tools and articles on his or her person. In addition, the utility apron would be effective in other professions and activities where there is a need to have tools, articles, and similar devices at a user's sides. Furthermore, the utility apron has the additional advantages in that it is extremely versatile in that:

the split two apron portion design is much more versatile and flexible allowing a user greater freedom of movement than traditional aprons;

it can be made in differing sizes to fit the specific physique of different users;

it can be made with a belt portion of differing widths, thickness, and circumference to fit the physique of different users;

it can be made with a wide variety of belt closures, in both the front and back, to meet the needs of different users;

the two-piece side release buckle is effective for ease of adornment and removal of the utility apron;

it can have its pockets and loops made in different sizes and placed in different locations to meet the unique needs of the user;

it can be made with differing apron portion sizes and thickness to meet the needs of an individual user;

it is reversible to meet the unique needs of both left-handed and right-handed users;

it can be made from a variety of natural or synthetic materials;

it can be made in a variety of colors and fabrics for fashionable design;

it is flexible enough to be worn in a variety of environments both natural and unnatural;

it is adaptable to many trades, industries, leisure activities, and uses where a person needs to have tools and articles positioned at his or her side, and, the same person or user needs to be able to move in an unrestricted manner;

it can be easily cleaned and prepared for multiple reuses; and it is lightweight, can be stored and transported easily, and can be removed and adorned with great ease.

Although the description above contains many specifications, these should not be construed as limiting the scope of the invention but as merely providing illustrations of some of the presently preferred embodiments of this invention. For example, the variety of belt and apron portion sizes, pocket and loop configurations, materials used for construction, and the variety of all elements of the apron is very large. Thus, the scope of the invention should be determined by the appended claims and their legal equivalents, rather than by the examples given.

I claim:

1. A utility apron providing for the carriage of tools and articles, said utility apron comprising:

An elongated planar belt portion having an inner surface, an outer surface, an upper edge and an opposite lower edge, a transverse centerline, and opposite first and second ends including mating attachment means securely coupled thereto and equidistantly spaced from said transverse centerline, and, third and fourth ends with mating attachment means securely coupled thereto and equidistantly spaced from said first and second ends, for removably securing said belt portion to a waist or abdomen of a user, with said outer surface having a plurality of vertically disposed belt loops secured thereto;

said belt portion further having first and second leg apron portions integrally connected to and depending therefrom with said apron portions having an inner surface, an outer surface, and a bottom edge, with a plurality of pockets and horizontally disposed pocket loops each securely coupled on said outer surface of said apron portions, and said pockets each having an open upper edge providing access thereto, whereby;

said utility apron is adapted to be secured about the waist or abdomen of the user with said apron portions disposed to the sides of the user, and, one of said mating attachment means of said belt portion disposed to the front of the user and a second of said mating attachment means disposed to the back of the user, and, user's tools and articles are adapted to be placed within said pockets and hooked to said pocket loops and said belt loops, to provide ease of access thereto by the user and ease of user's movements.

2. The utility apron of claim 1 wherein said belt portion's first and second ends' mating attachment means are horizontally disposed and comprise a buttonable closure or other suitable means to secure said belt portion around the user's waist.

3. The buttonable closure or other suitable means of claim 2 wherein said buttonable closure comprises one, two, or more rivets with attendant grommets.

4. The utility apron of claim 1 wherein said belt portion's third and fourth ends' mating attachment means are horizontally disposed and comprise a two-piece side release buckle further comprising releasably connectable male and female members where said male member includes a strap connector base portion on which a strap may be attached.

5. The mating attachment means of claim 4 wherein said third and fourth ends' mating attachment means additionally have complimentarily placed hook-and-loops fastener material whereby said ends may be removably hook-and-loops fastened together.

6. The utility apron of claim 1 wherein said belt loops are spaced transversely around said belt portion so that a first, second, third, and fourth belt loop may be equidistant apart.

7. The utility apron of claim 1 wherein said first and second leg apron portions depend from said belt portion as one contiguous piece of material.

8. The utility apron of claim 1 wherein said first and second leg apron portions depend from said belt portion in approximately the shape of a rectangle where one of the shorter ends of said approximate rectangle is integrally connected to said belt portion and said apron portions depend having a continuous width or a width that progressively narrows towards said bottom edge of said apron portions.

9. The utility apron of claim 1 wherein said first and second leg apron portions depend from said belt portion so that said apron portions transverse centerlines are positioned over the sides of the user.

10. The utility apron of claim 1 wherein said first, second, third, and fourth ends of said belt portion define a length there between and among, and said apron portions extend substantially along said belt portion.

11. The utility apron of claim 1 wherein said first, second, third, and fourth ends of said belt portion define a length there between and among, and said apron portions have a width measured transversely between opposing side edges.

12. The utility apron of claim 1 wherein said apron portions have a vertical length as measured from said belt portion to said bottom edge of said apron portions, and said apron portions have a width of between ⅔ and ⅞ of said vertical length.

13. The utility apron of claim 1 wherein said apron portions depend vertically whereby said bottom edge of each of said apron portion rests at least above the user's knee when said belt portion is secured around the user's waist or abdomen.

14. The utility apron of claim 1 wherein said pockets of said apron portions are positioned in two transverse rows on each of said apron portion, said transverse rows positioned one row vertically above a second row.

15. The utility apron of claim 1 wherein said pockets of said apron portions are positioned in two transverse rows on each of said apron portion, a lower row being located so that the bottom of said pockets rest along said bottom edge of each of said apron portion, and a second pocket row positioned above said lower row at a height located approximately halfway between said belt portion and said bottom edge of said apron portions.

16. The utility apron of claim 15 wherein one of said apron portions with said transverse rows of said pockets comprises two large cargo pockets, one large five section pocket, one large three section pocket, one small money pocket, and one pocket loop.

17. The utility apron of claim 16 wherein said large five section pocket is configured and dimensioned to retain brushes.

18. The utility apron of claim 15 wherein a second of said apron portions with said transverse rows of said pockets comprises of one small cargo pocket, six large open storage pockets, and one pocket loop.

19. The utility apron of claim 1 wherein said belt portion and said apron portions are formed of a natural or synthetic material, or a combination of natural and synthetic materials.

20. The utility apron of claim 19 wherein said belt portion and said apron portions are formed of denim.

* * * * *